United States Patent [19]

Ciccarelli

[11] 4,378,419

[45] Mar. 29, 1983

[54] DEVELOPER COMPOSITIONS CONTAINING TELOMERIC QUATERNARY SALTS

[75] Inventor: Roger N. Ciccarelli, Rochester, N.Y.

[73] Assignee: Xerox Corporation, Stamford, Conn.

[21] Appl. No.: 259,789

[22] Filed: May 1, 1981

[51] Int. Cl.[3] ..... G03G 9/10; G03G 9/14

[52] U.S. Cl. ..... 430/110; 430/904

[58] Field of Search ..... 430/110, 109, 106, 122, 430/904

[56] References Cited

U.S. PATENT DOCUMENTS

| | | | |
|---|---|---|---|
| 3,427,258 | 2/1969 | Trease | 252/500 |
| 3,893,935 | 7/1975 | Jadwin et al. | 252/62.1 |
| 3,944,493 | 3/1976 | Jadwin et al. | 252/62.1 |
| 3,970,571 | 7/1976 | Olson et al. | 252/62.1 |
| 4,021,358 | 5/1977 | Tomono et al. | 252/62.1 |
| 4,070,186 | 1/1978 | Gibson et al. | 96/1 |
| 4,070,296 | 1/1978 | Gibson et al. | 252/62.1 |
| 4,079,014 | 3/1978 | Burness et al. | 252/62.1 |
| 4,263,389 | 4/1981 | Ciccarelli | 430/106 |
| 4,298,672 | 11/1981 | Lo | 430/110 |
| 4,299,898 | 11/1981 | Williams | 430/122 |

*Primary Examiner*—John E. Kittle
*Assistant Examiner*—John L. Goodrow
*Attorney, Agent, or Firm*—E. O. Palazzo

[57] ABSTRACT

This invention is directed to a positively charged dry developer composition comprised of resin particles, pigment particles, carrier particles, and a telomeric quaternary salt charge enhancing additive of the formula:

$$[A_xB_y]_Z$$

wherein A represents a segment which is soluble/dispersible in the resin particles, B represents a quaternary salt segment, x and y are numbers representing mole fractions of A and B, the sum of x and y being equal to 1, and Z represents the degree of polymerization, wherein there results a telomeric quaternary salt having a number average molecular weight of from about 1,000 to about 10,000, and to a method of developing electrostatic latent images utilizing such compositions.

15 Claims, No Drawings

DEVELOPER COMPOSITIONS CONTAINING TELOMERIC QUATERNARY SALTS

BACKGROUND OF THE INVENTION

This invention is generally directed to toner and developer compositions, and more specifically to developer compositions containing as charge enhancing additives, resin dispersible telomeric quaternary salts. Toner compositions, resin plug pigment particles, and developers, toners plus carrier particles, containing such salts are useful in electrophotographic imaging systems for causing the development of images of high quality for a substantial number of imaging cycles. In one embodiment of the present invention there is provided toner compositions, resin and pigment and developer compositions, toner particles and carrier particles, wherein the toner particles are charged positively, as a result of the presence of the telomeric quaternary salt charge enhancing additive. The charge enhancing additive also functions in a manner so as to increase the admix charging rate of new uncharged toner particles that are added to a charged developer composition.

The electrophotographic process, and more specifically, the xerographic process is well known, as documented in several prior art references. In these processes, an electrostatic latent image is developed by applying electroscopic particles or toner to the electrostatic latent image, using, for example, the cascade development method as described in U.S. Pat. No. 3,618,552, magnetic brush development as described in U.S. Pat. Nos. 2,874,063 and 3,251,706, or touchdown development as described in U.S. Pat. No. 3,166,432. In some instances, it may be desirable in such systems to produce a reverse copy of the original, thus, for example, it may be desired to produce a negative copy from a positive original, or a positive copy from a negative original.

In U.S. Pat. No. 3,893,935, there is disclosed the use of certain quaternary ammonium salts as charge control agents for electrostatic toner compositions. According to the disclosure of this patent, certain quaternary ammonium salts when incorporated into toner materials were found to provide a toner composition which exhibited relatively high uniform and stable net toner charge, when mixed with a suitable carrier vehicle. U.S. Pat. No. 4,079,014 contains a similar teaching with the exception that a different charge control agent is used, namely a diazo type compound.

Many known developer compositions have a tendency to lose their positive charge over a period of time and in some instances, the charge enhancing additives used are incompatible with the thermoplastic resin, thus making it difficult to uniformly disperse or dissolve such materials in the toner composition. Also, the charge control agents as described in U.S. Pat. No. 3,893,935 are soluble in water, causing them to be leeched to the toner surface by moisture, thereby adversely affecting the machine environment, in which they are used and copy quality.

Some recently introduced commercial electrophotographic machines utilize organic photoconductors instead of inorganic photoconductors such as selenium, the organic photoconductors being charged negatively in comparison to selenium, which is charged positively. Accordingly, toner materials containing a positive charge thereon are needed for causing the proper development of images contained on the organic photoreceptor surface. While the prior art describes the use of charge control agents for imparting a positive charge to the toner resin, there continues to be a need for new materials which provide a high positive charge intensity to the toner resin, which intensity is maintained at relatively the same level over an extended period of time. Some charge control agents while they initially impart a positive charge to the toner resin may not be capable of maintaining that charge over a long period of time, and further such charge control agents may be incompatible with the development system, thereby adversely affecting the quality of the images developed. Also some of the prior art charge control agents are incompatible with the toner resin material which adversely affects the charge inducing properties of the charge control agent.

Accordingly, there is a need for toners and developers which can be used in a reversal imaging system, and more specifically, there is a need for positively charged toner materials, which positive charge is substantially high and can be maintained over an extended period of time, thus allowing the production of high quality images, in electrophotographic imaging systems.

SUMMARY OF THE INVENTION

It is an object of the present invention to provide toner and developer compositions, containing telomeric quaternary salts, which overcome the above-noted disadvantages.

It is a further object of the present invention to provide a developer composition, which contains toner particles and carrier particles, wherein the toner particles are charged positively, as a result of the presence of telomeric quaternary salts.

Another object of the present invention is the provision of developers which will develop electrostatic images containing negative charges on the photoreceptor surface, and which will transfer effectively electrostatically from such a photoreceptor to plain bond paper, without causing blurring or adversely affecting the quality of the image.

A further object of the present invention is to provide charge enhancing materials which are compatible with the toner resin, the charge enhancing materials having controlled dispersibility, that is, the degree of solubility/dispersibility is selected and controlled as desired.

A further additional object of the present invention is to provide charge enhancing materials which will not migrate or move from the toner particles to the carrier particles in a developer composition such movement adversely affecting the charge relationship involved and the final charge contained on the toner resin.

These and other objects of the present invention are accomplished by providing positively charged dry developer compositions, comprised of resin particles, pigment particles, carrier particles and a telomeric quaternary salt charge enhancing additive of the formula $$[A_xB_y]_Z$$

wherein A is a segment that is soluble/dispersible in the resin particles, B is a quaternary salt segment, which segments primary purpose is to control the toner charge electrical properties, x and y are numbers representing mole fractions of A and B, the sum of x and y being equal to 1, and Z represents the degree of polymerization, which polymerization is controlled and adjusted wherein there results a telomeric quaternary salt having a number average molecular weight of from about 1,000, to about 10,000. The anion associated with the quaternary salt segment B can be any suitable anion, examples of which include

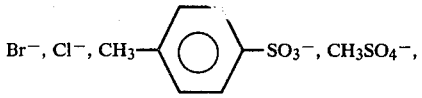

$Br^-$, $Cl^-$, $CH_3$—⟨○⟩—$SO_3^-$, $CH_3SO_4^-$, $NO_3^-$, $H_2PO_4^-$, $CH_3SO_3^-$, $CH_3SO_4^-$,

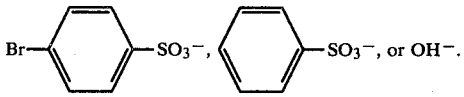

Br—⟨○⟩—$SO_3^-$, ⟨○⟩—$SO_3^-$, or $OH^-$.

Also included within the scope of the present invention, and within the definition of salts are the mineral acid salts, and organic acid salts of amines, such as the HCl, HBr, HI, $NHO_3$, $H_2SO_4$, etc. salts.

A may represent any segment that is compatible with the toner resin, however, illustrative examples of A include conventional vinyl monomers, and in particular, styrene and substituted styrenes, and acrylates such as alkylacrylates including methacrylates.

Illustrative examples of the B segment include for example, quaternary salts prepared from amine containing vinyl monomers, such as 2-vinylpyridine, 3-vinylpyridine, 4-vinylpyridine, substituted vinyl pyridines, amine acrylates and methacrylates such as mono and dialkylaminoethylmethacrylates, an example of which is dimethylaminoethylmethacrylate and the like. The letters x and y represent numbers with the provision that the sum of x plus y must be equal to 1. Thus y may represent the number 0.9 and x may represent the number 0.1, or x may represent the number 0.9 and y may represent a number 0.1. The ratio of x to y can for example be 0.75 to 0.25, 0.96 to 0.04, 0.0 to 1.0, 0.90 to 0.10, 0.98 to 0.02, and the like. In one embodiment of the present invention x represents the number 0.9 and y represents the number 0.1 the sum of x plus y being equal to 1.

The telomeric quaternary salts of the present invention are prepared by reacting the appropriate telomeric amines with certain quaternizing materials such as alkyl halides. Accordingly, there can be reacted from about 1 mole of a telomeric amine, such as styrene/4-vinyl pyridine, with about 1 to 25 moles of an alkyl halide, such as butyl chloride or butyl bromide, the reaction being accomplished at a temperature of from about 20 degrees Centigrade to about 120 degrees Centigrade, followed by sperating the desired product by known methods including filtering and washing. In order to obtain a telomeric quaternary salt of a number average molecular weight of from about 1,000 to about 10,000, the degree of polymerization Z is controlled, by for example, terminating the polymerization reaction utilizing a chain transfer agent, as described herein. Also the ratio of X to Y is obtained by adjusting the monomer feed ratios, and the reactivity ratios of the A and B segments described herein, thus reacting about 0.90 moles of styrene, with about 0.10 moles of vinyl pyridine results in a ratio of X to Y of 0.90:0.10. The type of reactions involved are described in Polymer Handbook, 2nd Edition, J. Brandrup and E. H. Immergut, John Wiley & Sons, New York, 1975, pages 11057, and Free Radical Telomerization, C. M. Starks, Academic Press, New York, 1974, the disclosure of which is totally incorporated herein by reference.

The novel telomeric amines employed in the reaction are prepared in accordance with the disclosure of copending application U.S. Ser. No. 259,639, filed May 1, 1981, in the name of Roger N. Ciccarelli, the subject matter of which is totally incorporated herein by reference. Thus for example, the telomeric amines are prepared by reacting an appropriate monomer such as styrene, with a vinyl pyridine, in the presence of a chain transfer agent.

The chain transfer agent employed in the preparation of the quaternary salts of the present invention is selected in accordance with the following equation:

$$\frac{[TX]}{[A]} = \frac{1}{\overline{T}} \quad \frac{[\pi BX^2 + 2X + \pi A]}{[\pi B C_{BT} X + \pi A C_{AT}]}$$

where [TX]=chain transfer agent concentration in moles.

wherein [A] and [B]=monomer concentration in moles.

where $\overline{T}$=average degree of polymerization where $$X = \frac{[B]}{[A]}$$

where $\pi_A$ and $\pi_B$ are monomer reactivity ratios.

where $C_{AT}$ and $C_{BT}$ are the chain transfer constants.

Among suitable chain transfer agents are carbon tetrachloride, iso-butyraldehyde, n-butyraldehyde, and the like, with n-butyraldehyde being preferred.

Also, Z, the degree of polymerization can be controlled by proper choice and concentration of a suitable initiator such as benzoylperoxide and azo-bis-isobutyronitrile to produce oligomers having the desired molecular weight.

Illustrative specific materials embraced by the above-identified formula include quaternary salts, anhydrous, hydrated, or partially hydrated, prepared from telomeric and oligomeric amine copolymers such as, styrene/4-vinylpyridine, styrene/2-vinylpyridine, styrene/3-vinylpyridine, styrene/dimethylaminoethylmethacrylate, styrene/t-butylaminoethylmethacrylate, n-butylmethacrylate/4-vinylpyridine, n-butylmethacrylate/2-vinylpyridine, n-butylmethacrylate/3-vinylpyridine, n-butylmethacrylate/dimethylaminoethylmethacrylate, n-butylmethacrylate/t-butylaminoethylmethacrylate, and the like. There may be substituted for the styrene and butyl acrylate segments, alkyl and halo substituted styrenes, acrylates, alkyl substituted methacrylates, while alkyl substituted vinyl pyridines may be substituted for the vinyl pyridines. Typical alkyl substituents include methyl, ethyl, propyl, butyl, pentyl, hexyl, and the like. Illustrative examples of telomeric quaternary salts prepared from the above amine copolymers include styrene/vinyl-N-alkyl pyridinium halides, styrene/2-vinyl-N-ethyl pyridinium chloride monohydrate, styrene/2-vinyl-N-butyl pyridinium chloride monohydrate, styrene/3-vinyl-N-butyl pyridinium chloride monohydrate, styrene/4-vinyl-N-butyl pyridinium chloride, styrene/2-vinyl-N-butyl pyridinium bromide monohydrate, styrene/3-vinyl-N-butyl pyridinium bromide monohydrate, styrene/4-vinyl-N-butyl pyridinium bromide monohydrate, and the like.

The amount of telomeric quaternary salt added to the toner resin ranges from about 0.1 percent by weight to about 50 percent by weight and preferably from about 0.1 percent by weight to about 20 percent by weight. The amount of telomeric quaternary salt employed can be outside these ranges providing that such amounts accomplish the objectives of the present invention. The telomeric and/or oligomeric quaternary salts can be blended into the system or coated onto the pigment or colorant such as carbon black, which is part of the developing composition.

Numerous methods may be employed to produce the toner of the present invention. One method involves melt blending the resin and the pigment coated with the quaternary telomeric salt followed by mechanical attrition. Other methods include those well known in the art such as spray drying, melt dispersion, and dispersion polymerization. For example, a solvent dispersion of a resin, pigment and telomeric salt are spray dryed under controlled conditions, thereby resulting in the desired product. Such a toner prepared in this manner results in a positively charged toner in relationship to the carrier materials used, and these materials exhibit the improved properties such as rapid admix charging as mentioned herein.

While any suitable resin may be employed in the developer of the present invention, typical of such resins are polyamides, epoxies, polyurethanes, vinyl resins and polyester especially those prepared from dicarboxylic acids and diols comprising diphenols. Any suitable vinyl resin may be employed in the toners of the present system, including homopolymers or copolymers of two or more vinyl monomers. Typical of such vinyl monomeric units include: styrene, p-chlorostyrene, vinyl naphthalene, ethylenically unsaturated mono-olefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of ethylinic aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidone and the like; and mixtures thereof.

Generally toner compositions containing a relatively high percentage of styrene are preferred. The styrene resin employed may be a homopolymer of styrene or styrene homologs or copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired, preferably other vinyl resins, which insure good triboelectric properties and uniform resistance against physical degradation. However, nonvinyl type thermoplastic resins may also be employed including resin modified phenolformaldehyde resins, oil modified epoxy resins, polyurethane resins, cellulosic resins, polyether resins, and mixtures thereof.

Also esterification products of a dicarboxylic acid, and a diol comprising a diphenol may be used as a preferred toner resin material for the toner composition of the present invention. These materials are illustrated in U.S. Pat. No. 3,655,374 totally incorporated herein by reference, the diphenol reactant being of the formula as shown in column 4, beginning at line 5 of the '374 patent, and the dicarboxylic acid is of the formula as shown in column 6 of the above patent. The resin is present in an amount so that the total of all ingredients used in the toner total 100%, thus when 5% by weight of the telomeric composition is used, with 10% by weight of pigment or colorant such as carbon black, about 85% by weight of resin material is used.

Optimum electrophotographic resins are obtained with styrene butylmethacrylate copolymers, styrene vinyl toluene copolymers, styrene acrylate copolymers, polyester resins, predominantly styrene or polystyrene base resins as generally described in U.S. Pat. No. 25,136 to Carlson, polystyrene blends as described in U.S. Pat. No. 2,788,288 to Rheinfrank and Jons, and styrene-butadiene resins.

Any suitable pigment or dye may be employed as the colorant for the toner particles, such materials being well known and including for example, carbon black, nigrosine dye, aniline blue, calco oil blue, chrome yellow, ultramarine blue, DuPont oil red, methylene blue chloride, phthalocyanine blue and mixtures thereof. The pigment or dye should be present in the toner in sufficient quantity to render it highly colored, so that it will form a clearly visible image on the recording member. For example, where conventional xerographic copies of documents are desired, the toner may comprise a black pigment, such as carbon black, or a black dye such as Amaplast black dye available from the National Aniline Products, Inc. Preferably, the pigment is employed in amounts of from about 3% to about 20% by weight based on the total weight of toner, however, if the colorant employed is a dye, substantially smaller quantities may be used.

Any suitable carrier material can be employed, providing such carrier particles are capable of triboelectrically obtaining a charge of opposite polarity to that of the toner particles. In the present invention in one embodiment that would be a negative polarity, so that the toner particles will adhere to and surround the carrier particles. Examples of suitable carrier materials include sodium chloride, ammonium chloride, potassium chloride, Rochelle salt, sodium nitrate, aluminum nitrate, potassium chlorate, granular zircon, granular silicon, methylmethacrylate, glass, steel, nickel, iron ferrites, silicon dioxide and the like, with metallic carriers, especially magnetic carriers being preferred. The carriers can be used with or without a coating. The coatings generally contain fluorinated polymers such as polyvinyl fluoride resins, but other resins especially those which charge negatively, such as polystyrene, halogen containing ethylenes and the like can be used. Many of the typical carriers that can be used are described in U.S. Pat. Nos. 2,618,441; 2,638,522; 3,618,522; 3,591,503; 3,533,835; and 3,526,533. Also nickel berry carriers as described in U.S. Pat. Nos. 3,847,604 and 3,767,598 can be employed, these carriers being nodular carrier beads of nickel characterized by a surface of reoccurring recesses and protrusions providing particles with a relatively large external area. The diameter of the coated carrier particle is from about 50 to about 1000 microns, thus allowing the carrier to possess sufficient density and inertia to avoid adherence to the electrostatic images during the development process.

The carrier may be employed with the toner composition in any suitable combination, however, best results are obtained when about 1 part per toner is used, to about 10 to about 200 parts by weight of carrier.

The method of the present invention comprises forming a negative electrostatic latent image on an image bearing member, such as a photoreceptor, contained in an electrophotographic imaging system, contacting the image with the positively dry developer composition described herein, followed by subsequently transferring the developed latent image to a substrate, and permanently affixing the image thereto.

Developing compositions of the present invention may be used to develop electrostatic latent images on any suitable electrostatic surface capable of retaining charge including conventional photoconductors, however, the developers of the present invention are best utilized in systems wherein a negative charge resides on the photoreceptor, and this usually occurs with organic photoreceptors, illustrative examples of such photoreceptors being polyvinyl carbazole, 2-benzylidene-amino-carbazole, 4-dimethylamino-benzylidene, benzhydrazide; (2-nitro-benzylidene)-p-bromoaniline; 2,4-diphenyl-quinazoline; 1,2,4-triazine; 1,5-diphenyl-3-methyl pyrazoline 2-(4'-dimethyl-amino phenyl)-benzoxazole; phthalocyanines and mixtures thereof.

By developer composition as used herein is meant toner particles, plus carrier particles, and charge enhancing additive, with the toner particles being comprised of resin particles, and a colorant or pigment, such as carbon black.

Toner and developer compositions containing the telomeric quaternary enhancing salt of the present invention also rapidly charge new uncharged toner, toner plus resin, being added as replenishment material to a developer composition. This is known as rapid admix charging. By admix charging is meant providing the appropriate charges, for example, in the present invention, positive charges, at a rapid rate to new uncharged toner, replenishment toner being added to the toner which already contains charges thereon. As is customary in xerographic imaging systems, new toner, that is, toner resin plus colorant, must be added to the system as toner is being consumed for the development of images. In the past, the new uncharged toner being added did not obtain appropriate charge until a significant period of time had elapsed, for example, after 10 to 15 minutes. This adversely effected the developer composition and thus good high quality images would not result until a new uncharged toner had acquired the appropriate electrical charges. In some instances, no images whatsoever could be developed until the uncharged toner was mixed with the charged toner in the machine system being used, which usually involved 10 to 15 minutes mixing time. With the telomeric quaternary salt of the present invention, the rate at which the uncharged toner acquires positive charge, is substantially less than 10 minutes. Typically, the uncharged toner becomes suitably charged within from about one minute to about five minutes, and preferably less than three minutes. Such rapid admix charging allows the developer system to become more stable over a shorter period of time as compared to prior art systems, therefore, better quality images are obtained with no background. This was a significant finding that was not appreciated by the prior art.

The following examples are being supplied to further define the species of the present invention, it being noted that these examples are intended to illustrate and not limit the scope of the present invention. Parts and percentages are by weight unless otherwise indicated, and Z represents the degree of polymerization, wherein there results the materials of the molecular weights indicated.

EXAMPLE I

There was prepared the telomer styrene/4-vinylpyridine by heating together a mixture of 83.3 grams of purified styrene monomer, 21.0 grams of purified 4-vinylpyridine monomer, 243.5 grams of n-butyraldehyde, and 2.1 grams of 2,2'-azo-bis-isobutyronitrile (AIBN) for 21 hours at 75° C. under an argon blanket. The monomers were purified before use by treatment with Basic Alumina Woelm B. The telomeric amine was isolated by precipitation into a large excess of isomeric hexanes (Fisher H-291) (boiling range 65°-68° C.). The telomer was then purified by dissolving in chloroform, followed by washing with dilute aqueous sodium hydroxide solution, drying over Linde Molecular Sieve No. 4A, and then precipitated by adding the telomer to a large excess of isomeric hexanes. The resulting product was then vacuum dried, in an oven. There was isolated in a 70 percent yield a styrene/4-vinylpyridine telomer of the formula

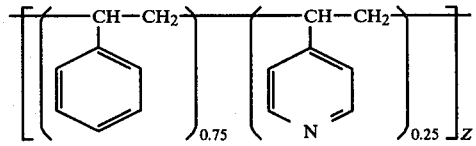

This telomer had a number average molecular weight of 2,500, and a weight average molecular weight of 5,100. The styrene mole fraction 0.75, and the 4-vinylpyridine mole fraction 0.25 were experimentally verified by elemental carbon/hydrogen/nitrogen analysis. Found: 88.78% C, 8.01% H, 3.35% N; Calc: 89.15% C, 7.50% H, 3.36% N.

EXAMPLE II

There was prepared the quaternary salt telomer, styrene/4vinyl-N-butylpyridinium bromide monohydrate, by heating together a mixture of 125 grams of the styrene/4-vinylpyridine telomer prepared in Example I, 825 grams of n-butylbromide (Eastman #51), and 1,400 grams of acetonitrile (Baker #3-9255) for 120 hours at 75° C. under an argon blanket. The solution was filtered and then vacuum stripped to dryness on a Buchi-Rotavapor-R rotary evaporator. Vacuum conditions are slowly increased from 25° C./80 mm. to a final 70° C./50 mm. Hg pressure. The product is dried in a vacuum oven at 60° C. for 20 hours. There was isolated in 96 percent yield a styrene/4-vinylN-butylpyridinium bromide monohydrate telomer of the formular:

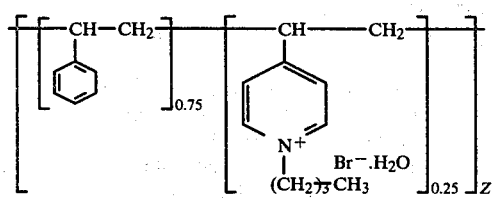

This material had a number average molecular weight of 3,400 and a weight average molecular weight of 7,000. The styrene mole fraction 0.75 and the 4-vinyl-N-butylpyridinium bromide monohydrate mole fraction 0.25 were experimentally verified by elemental carbon/hydrogen/nitrogen/bromine/oxygen analysis, and Karl Fischer water analysis. Found: 73.40% C, 7.42% H, 2.52% N, 13.76% Br, 2.85% O, 3.25% $H_2O$; Calc: 73.40% C, 7.41% H, 2.45% N, 13.95% Br, 2.79% O, 3.15% $H_2O$.

EXAMPLE III

The procedure of Example I was repeated with the exception that the ratio of styrene monomer to 4-vinylpyridine monomer was adjusted in order to prepare a styrene/4-vinylpyridine telomer having a styrene mole fraction of 0.96 and a 4-vinylpyridine mole fraction of 0.04.

EXAMPLE IV

The procedure of Example I was repeated with the exception 4-vinylpyridine monomer was polymerized in the absence of styrene monomer to prepare a 4-vinylpyridine telomer having a 4-vinylpyridine mole fraction of 1.0.

EXAMPLE V

The procedure of Example II was repeated with the exception that the 4-vinylpyridine telomer from Example IV was quaternized with n-butylbromide. There was isolated the quaternary salt telomer, 4-vinyl-N-butylpyridinium bromide monohydrate of the formula

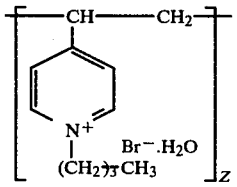

This material had an average number molecular weight of about 3,200.

EXAMPLE VI

The procedure of Examples I and II was repeated with the exception that there was prepared the telomers styrene/2-vinylpyridine, and styrene/3-vinylpyridine, and these telomers were reacted with n-butyl bromide in accordance with the procedure of Example II, whereby there resulted the quaternary salt telomers styrene/2-vinyl-N-butylpyridinium bromide monohydrate, and styrene/3-vinyl-N-butylpyridinium bromide monohydrate. In a like manner, the corresponding chloride quaternary salts were prepared by reacting the respective telomers with n-butylchloride in a pressure reactor.

EXAMPLE VII

A toner composition was prepared by melt blending, followed by mechanical attrition, 3.2 parts of the styrene/4-vinyl-N-butylpyridinium bromide monohydrate quaternary salt telomer of Example II with 6 parts Regal 330 carbon black and 90.8 parts of a styrene/n-butylmethacrylate resin, 65 percent by weight of styrene, 35 percent by weight of n-butylmethacrylate. The resulting blend was attrited and classified resulting in toner particles. Two and one half parts, (2.5 parts) of this toner, and 97.5 parts of a carrier comprised of 0.175 percent Kynar 201, vinylidene fluoride resin available from Penwalt Corporation, coated on atomized steel carrier, were blended into a developer composition. The developer composition was roll milled, and after 10 minutes of roll milling the triboelectric charge on the toner was measured and found to be +63 uc/gram (microcoulombs per gram). This developer was tested in an imaging fixture using the photoreceptor polyvinylcarbazole charged negatively and good quality prints of excellent resolution were obtained.

EXAMPLE VIII

The procedure of Example VII was repeated with the exception that the toner composition was comprised of 3.2 parts of the quaternary salt of Example II, 8 parts Regal 330 carbon black, and 88.8 parts styrene/n-butylmethacrylate resin. The triboelectric charge on the toner after 10 minutes of roll milling was +48 uc/gram.

EXAMPLE IX

The procedure of Example VII was repeated with the exception that the toner composition was comprised of 0.4 parts of the quaternary salt telomer of Example II, 6 parts carbon black, and 93.6 parts of the styrene/n-butylmethacrylate resin. The triboelectric charge on the toner after 10 minutes of roll milling was +41 uc/gram.

EXAMPLE X

The procedure of Example VII was repeated with the exception that the toner composition was comprised of 0.8 parts of the quaternary salt telomer of Example II, 8 parts carbon black, and 91.2 parts of the styrene/n-butylmethacrylate resin. The triboelectric charge on the toner after 10 minutes of roll milling was +46 uc/gram.

EXAMPLE XI

The procedure of Example VII was repeated with the exception that the toner composition was comprised of 0.4 parts of the quaternary salt telomer of Example II, 6 parts Regal 330 carbon black, and 93.6 parts of a styrene/butadiene resin, 90 percent by weight of styrene, 10 percent by weight of butadiene. The triboelectric charge on the toner after 10 minutes of roll milling was +32 uc/gram, as determined using a Faraday cage.

EXAMPLE XII

The procedure of Example VII was repeated with the exception that the toner composition which was comprised of 3.2 parts of the quaternary salt telomer of Example II, 6 parts Regal 330 carbon black, and 88.8 parts styrene/n-butylmethacrylate resin was prepared by solution blending the components, followed by solvent removal, and then attrition and classification to prepare toner particles. The triboelectric charge on the toner after 10 minutes of roll milling was +50 uc/gram.

Good quality prints of excellent resolution resulted when the developer composition of Examples VII, IX, X, XI and XII were tested in the same imaging fixture as used in Example VII.

A Faraday cage was employed to determine the triboelectric charge on the above toner compositions.

Other modifications of the present invention may occur to those skilled in the art upon a reading of the present disclosure and these are intended to be encompassed within the scope of the present invention.

What is claimed is:

1. A positively charged dry developer composition comprised of resin particles, pigment particles, carrier particles, and a telomeric quaternary salt charge enhancing additive of the formula:

$$[A_xB_y]_Z$$

wherein A represents a segment which is soluble/dispersible in the resin particles, B represents a quaternary salt prepared from amine containing vinyl monomers, amine acrylates or amine methacrylates segment, x and y are numbers representing mole fractions of A and B, the sum of x and y being equal to 1, and Z represents the degree of polymerization, wherein there results a telomeric quaternary salt having a number average molecular weight of from about 1,000 to about 10,000.

2. A positively charged dry developer composition in accordance with claim 1 wherein the ratio of x to y is 0.96:0.04, 0.75:0.25, 0:1.0, 0.98:0.02, or 0.90:0.10.

3. A positively charged dry developer composition in accordance with claim 1 wherein the resin is a styrene butylmethacrylate copolymer, or a styrene butadiene copolymer, the pigment is carbon black, and the carrier material consists of a steel core coated with a vinylidene fluoride resin.

4. A positively charged dry developer composition in accordance with claim 3 wherein the styrene butylmethacrylate resin is a styrene/n-butylmethacrylate resin containing 65 percent by weight of styrene and 35 percent by weight of n-butylmethacrylate, and the styrene butadiene resin contains 90 percent by weight of styrene and 10 percent by weight of butadiene.

5. A positively charged dry developer composition in accordance with claim 1 wherein the telomeric quaternary salt charge enhancing additive is a styrene/vinyl-N-alkylpyridinium halide.

6. A positively charged dry developer composition in accordance with claim 5 wherein the telomeric quaternary salt charge enhancing additive is styrene/2-vinyl-N-butylpyridinium chloride monohydrate, styrene/3-vinyl-N-butylpyridinium chloride monohydrate, or styrene/4-vinyl-N-butylpyridinium chloride monohydrate.

7. A positively charged dry developer composition in accordance with claim 5 wherein the telomeric quaternary salt charge enhancing additive is styrene/2-vinyl-N-butylpyridinium bromide monohydrate, styrene/3-vinyl-N-butylpyridinium bromide monohydrate, or styrene/4-vinyl-N-butylpyridinium bromide monohydrate.

8. A method of imaging comprising forming a negative electrostatic latent image on a photoreceptor surface present in a xerographic imaging apparatus, contacting the image with the positively dry electrostatic developer composition of claim 1, followed by subsequently transferring the developed image to a substrate and permanently affixing the image thereto.

9. A method of imaging in accordance with claim 8 wherein the resin is a styrene butylmethacrylate composition, or a styrene butadiene composition, the carrier consists of a steel core coated with a vinylidene fluoride polymer, and the pigment is carbon black.

10. A method of imaging in accordance with claim 9 wherein the styrene butylmethacrylate resin is a styrene/n-butylmethacrylate consisting of 65 percent by weight of styrene and 35 percent by weight of n-butylmethacrylate, and the styrene butadiene resin consists of 90 percent by weight of styrene and 10 percent by weight of butadiene.

11. A method of imaging in accordance with claim 9 wherein the telomeric quaternary salt is styrene/2-vinyl-N-butylpyridinium chloride monohydrate, styrene/3-vinyl-N-butylpyridinium chloride monohydrate, styrene/4-vinyl-N-butylpyridinium chloride monohydrate, styrene/2-vinyl-N-butylpyridinium bromide monohydrate, styrene/3-vinyl-N-butylpyridinium bromide monohydrate or styrene/4-vinyl-N-butylpyridinium bromide monohydrate.

12. A positively charged dry developer composition in acordance with claim 1 wherein A is a vinyl monomer, and the telomeric quaternary salt is present in an amount of from about 0.1 percent to about 20 percent.

13. A positively charged dry developer composition in accordance with claim 1 wherein A is styrene, acrylate, or methacrylate.

14. A positively charged dry developer composition in accordance with claim 1 wherein the telomeric quaternary salt charge enchaning additive is a styrene/4-vinyl-N-butylpyridinium bromide monohydrate telomer of the formula:

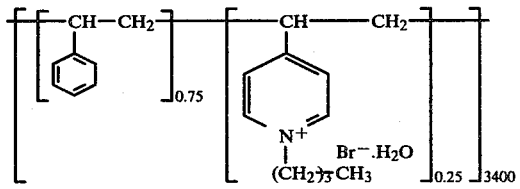

15. A positively charged dry developer composition in accordance with claim 1 wherein the telomerič quaternary salt charge enchancing additive is 4-vinyl-N-butylpyridinium bromide monohydrate of the formula:

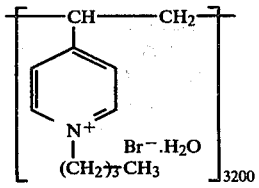

* * * * *